US011566200B2

(12) United States Patent
Han et al.

(10) Patent No.: US 11,566,200 B2
(45) **Date of Patent: *Jan. 31, 2023**

(54) POLYALKYLENE GLYCOL LUBRICANT COMPOSITIONS

(71) Applicant: Dow Global Technologies LLC, Midland, MI (US)

(72) Inventors: Yaokun Han, Shanghai (CN); Martin R. Greaves, Baar (CH); Yong Zhao, Shanghai (CN); Cheng Shen, Shanghai (CN); Tao Wang, Shanghai (CN); Jieying Chen, Shanghai (CN)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/427,793

(22) PCT Filed: Mar. 5, 2019

(86) PCT No.: PCT/CN2019/077036

§ 371 (c)(1),
(2) Date: Aug. 2, 2021

(87) PCT Pub. No.: WO2020/177085

PCT Pub. Date: Sep. 10, 2020

(65) Prior Publication Data

US 2022/0127542 A1 Apr. 28, 2022

(51) Int. Cl.

| | |
|---|---|
| ***C10M 145/38*** | (2006.01) |
| ***C10M 101/00*** | (2006.01) |
| ***C10M 129/10*** | (2006.01) |
| ***C10M 145/32*** | (2006.01) |
| ***C10M 145/34*** | (2006.01) |
| ***C10M 169/04*** | (2006.01) |
| *C10N 20/02* | (2006.01) |
| *C10N 30/10* | (2006.01) |
| *C10N 40/25* | (2006.01) |

(52) U.S. Cl.

CPC ..... *C10M 145/38* (2013.01); *C10M 101/00* (2013.01); *C10M 129/10* (2013.01); *C10M 145/32* (2013.01); *C10M 145/34* (2013.01); *C10M 169/044* (2013.01); *C10M 2205/003* (2013.01); *C10M 2207/023* (2013.01); *C10M 2209/107* (2013.01); *C10M 2209/109* (2013.01); *C10N 2020/02* (2013.01); *C10N 2030/10* (2013.01); *C10N 2040/25* (2013.01)

(58) Field of Classification Search

CPC ..... C10M 2209/108; C10M 2209/109; C10M 2209/105; C10M 2209/106; C10M 2209/103; C10M 2209/107; C10M 145/38; C10M 169/041; C10M 2203/1006; C10M 2003/1025; C10M 2205/0285; C10N 2020/02; C10N 2030/02; C10N 2030/06

See application file for complete search history.

(56) References Cited

U.S. PATENT DOCUMENTS

| | | | |
|---|---|---|---|
| 1,988,299 | A | 1/1935 | Clark et al. |
| 2,000,045 | A | 5/1935 | Sloan et al. |
| 2,202,877 | A | 6/1940 | Stevens et al. |
| 2,248,830 | A | 7/1941 | Stillson et al. |
| 2,265,582 | A | 12/1941 | Stevens et al. |
| 2,620,304 | A | 12/1952 | Stewart et al. |
| 2,620,308 | A | 12/1952 | Stewart et al. |
| 2,868,730 | A | 1/1959 | Wood-Mallock et al. |
| 3,032,502 | A | 5/1962 | Barnes et al. |
| 3,038,858 | A | 6/1962 | Verley et al. |
| 3,038,859 | A | 6/1962 | Eickemeyer et al. |
| 3,043,775 | A | 7/1962 | Coffield et al. |
| 3,065,178 | A | 11/1962 | Nunn et al. |

(Continued)

FOREIGN PATENT DOCUMENTS

| | | | |
|---|---|---|---|
| EP | 892037 | A1 | 1/1999 |
| GB | 1030399 | A | 5/1966 |

(Continued)

OTHER PUBLICATIONS

PCT/CN2019/077036, International Search Report and Written Opinion dated Dec. 11, 2019.

*Primary Examiner* — Vishal V Vasisth

(57) ABSTRACT

The present disclosure provides A lubricant composition comprises an antioxidant; and an esterified polyalkylene glycol: $R^1[O(R^2O)_n(R^3O)_m(C{=}O)R^4]_p$, wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4, wherein the antioxidant is present in an amount by weight of at least 0.5% to 20% based upon the weight of the antioxidant and the esterified polyalkylene glycol and the antioxidant is soluble in the esterified polyalkylene glycol in an amount of at least 0.5% by weight. The lubricant composition may be used as an additive to form a hydrocarbon lubricant composition.

20 Claims, No Drawings

(56) References Cited

U.S. PATENT DOCUMENTS

| | | | | |
|---|---|---|---|---|
| 3,132,103 | A | 5/1964 | Teeter et al. | |
| 4,959,169 | A | 9/1990 | McGraw et al. | |
| 4,968,453 | A * | 11/1990 | Wada | C10M 111/04 508/499 |
| 5,707,945 | A | 1/1998 | Cooban et al. | |
| 7,687,445 | B2 | 3/2010 | Rosenbaum et al. | |
| 2009/0241562 | A1 | 10/2009 | Thomas et al. | |
| 2010/0120639 | A1* | 5/2010 | Thoen | C10M 111/04 508/516 |
| 2014/0249063 | A1 | 9/2014 | Greaves et al. | |
| 2015/0337230 | A1* | 11/2015 | Delbridge | C10M 165/00 508/175 |
| 2016/0272916 | A1 | 9/2016 | Kashani-Shirazi et al. | |
| 2017/0211009 | A1 | 7/2017 | Khelidj et al. | |

FOREIGN PATENT DOCUMENTS

| | | | |
|---|---|---|---|
| JP | H07305079 | A | 11/1995 |
| WO | 1987/005320 | A2 | 9/1987 |
| WO | 2016032246 | A1 | 3/2016 |
| WO | 2019/126923 | A1 | 7/2019 |
| WO | 2019/126924 | A1 | 7/2019 |

* cited by examiner

POLYALKYLENE GLYCOL LUBRICANT COMPOSITIONS

This application is a 371 of PCT/CN2019/077036, filed Mar. 5, 2019.

TECHNICAL FIELD

The present disclosure relates to polyalkylene glycols, and more specifically to modified polyalkylene glycol compositions containing antioxidants having improved properties as well as hydrocarbon oil based lubricants containing said polyalkylene glycol antioxidant compositions.

BACKGROUND

The majority of lubricants used today in equipment are manufactured using a hydrocarbon base oil. This is typically a mineral oil or a synthetic hydrocarbon oil (such as a polyalphaolefin). The American Petroleum Institute (API) has segmented hydrocarbon base oils into Group I, II, III and IV base oils based on their viscosity indices, saturate levels and sulphur levels.

Transportation lubricants such as engine lubricants are often formulated with API Group I-IV base oils. Research continues in developing more energy efficient lubricants. One way of accomplishing this is to use lubricants with a lower overall viscosity, but sufficient to maintain lubricity (low friction). Lower viscosity lubricants often use lower viscosity base oils such as lower viscosity API Group I-IV hydrocarbon oils. These are often more volatile and also typically have lower viscosity indices (VI). There is a need for lubricants having a high viscosity index. Group IV base oils (synthetic polyalphaolefins, PAO) have the highest VI values, but are expensive. Group III base oils (typically referred to as semi-synthetic) are still expensive but have higher values than Groups I and II base oils.

Viscosity indices are a measure of how much the viscosity of an oil changes over a temperature range. It is derived from a calculation based on the kinematic viscosity at 40° C. and 100° C. using ASTM D2270. Higher viscosity index values correspond to less change in viscosity over this temperature range. Lubricants having a high viscosity index are desirable so as to maintain a more consistent viscosity over a broad temperature range. For example in an automotive engine if the oil viscosity becomes too high, then fuel efficiency decreases. If the oil viscosity becomes too low, excessive engine wear can occur. Fluids that show only minor changes in viscosity (i.e, they have a high viscosity index) across this temperature range are desirable.

Viscosity index improvers are additives that tend to reduce the change in oil viscosity over a temperature range. Typical viscosity index improvers include, for example, polyalkylmethacrylates and olefin copolymers. Unfortunately, while viscosity index improvers can increase the viscosity index of the base oils used in engine oil, they almost always significantly increase the viscosity of the engine oil at low temperature (e.g., 0° C., −10° C. or −20° C.). Low temperature viscosity is important to consider when starting an engine in low temperature environments. While it is important for an engine oil to form a film that is viscous enough to prevent wear in order to protect engine components, it is also important that the engine oil is not so viscous so as to cause high frictional losses due to excessive viscous drag from the oil. Therefore, it is highly desirable to find lubricants or additives or co-base fluids which also reduce low temperature viscosity (e.g., at 0° C. or −20° C.).

Lubricants must also maintain these properties under operating conditions to prolong their useful life. Lubricants may, during high temperature operation, thicken due to volatilization of lower molecular weight fractions within the base oil. This volatility is given by NOACK Air volatility according to ASTM D6375. Likewise, lubricants may radically polymerize due to oxidation to form sludge, deposits and varnish on equipment which can lead to significant operation problems of the equipment such as valve sticking and excessive wear. Typically, antioxidants are used to reduce or delay such oxidation and radical polymerization.

Oil-Soluble Polyalkylene Glycols (OSP) sold under the tradename UCON™ OSPs, are polyethers terminated with an alcohol. Unlike conventional polyalkylene glycols (PAG) derived from ethylene oxide (EO) and propylene oxide (PO), OSPs are soluble in hydrocarbon oils. Today the majority of lubricants are based on hydrocarbon oils with OSPs being used as additives. The OSPs help to improve friction and control deposit formation as the fluid ages. Unfortunately some very low viscosity OSPs (with a kinematic viscosity at 100° C. of about 4 $mm^2$/sec or less as measured by ASTM D445) have low viscosity index values (e.g., viscosity index~120) and high NOACK air volatility. It would be desirable to provide an OSP lubricant having improved NOACK air volatility as well as a hydrocarbon base lubricant base oil—OSP lubricant composition having improved properties.

SUMMARY OF INVENTION

The invention described herein realizes a lubricant composition comprised of an Esterified Oil-Soluble Polyalkylene Glycol (E-OSP) and an antioxidant that surprisingly improves the NOACK air volatility compared to the OSP alone. Likewise, the OSP antioxidant composition when used as an additive to a hydrocarbon base oil allows for the incorporation of the antioxidant at higher useful concentrations while it may also decrease the NOACK air volatility.

A first aspect of the invention is a lubricant composition, comprising:

an antioxidant; and an esterified polyalkylene glycol:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4, wherein the antioxidant is present in an amount by weight of 0.5% to 20% based upon the weight of the antioxidant and the esterified polyalkylene glycol and the antioxidant is soluble in the esterified polyalkylene glycol in an amount of at least 0.5% by weight. The lubricant formulation is preferably used in internal combustion engines.

The present disclosure further includes embodiments of the lubricant formulation in which $R^3O$ is derived from 1,2-butylene oxide. Other preferred values for the E-OSP of Formula I include where $R^4$ is a linear alkyl with 1 to 8 carbon atoms. Preferably, $R^1$ is a linear alkyl with 10 to 14 carbon atoms A second aspect of the invention is a lubricant composition comprised of the lubricant composition of the first aspect and a hydrocarbon base oil, wherein the antioxidant is present in an amount by weight of at least 0.1% to 10% based upon the weight of the lubricant composition and the antioxidant is soluble in the esterified polyalkylene glycol in an amount of at least 0.5% by weight and the hydrocarbon oil is present in the composition in an amount of at least 50% by weight of the total weight of the lubricant composition.

A third aspect of the invention is a method of forming a lubricant composition comprising:

(i) dissolving, first, an antioxidant into an esterified polyalkylene glycol represented by the following structure:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4, to form a solution of the antioxidant and esterified polyalkylene glycol, and then (ii) admixing a base hydrocarbon oil with the solution of the antioxidant and esterified polyalkylene glycol to form the lubricant composition, wherein said lubricant composition is a homogeneous solution.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

The present disclosure provides for a lubricant comprised of an E-OSP and an antioxidant that surprisingly substantially improves the NOACK air volatility even though antioxidants are essentially additives that prevent radical formation leading to high molecular weight sludge. These surprising and unexpected properties are believed to be the result of esterified OSPs, which appear to solvate well with antioxidants reducing the NOACK volatility in some manner. In addition the esterified OSPs in solution with the antioxidants likewise show improvements in NOACK volatility even when mixed with hydrocarbon base oils and allows for greater addition to the base oil of the antioxidant. The E-OSP antioxidant of the present disclosure are particularly useful as a lubricant itself, but they may also be added as an additive (up to 50 wt. % based on weight of the total composition) with a base oil to form a lubricant formulation that is useful in an internal combustion engine.

The lubricant composition is comprised of an esterified oil-soluble polyalkylene glycol (E-OSP) of Formula I:

$$R^1[O(R^2O)_n(R^3O)_m(C{=}O)R^4]_p \qquad \text{Formula I}$$

$R^1$ is a linear alkyl having 1 to 18 carbon atoms, a branched alkyl having 4 to 18 carbon atoms or an aryl with 6 to 30 carbon atoms. Preferably, $R^1$ is a linear alkyl with 10 to 14 carbon atoms. $R^2O$ is an oxypropylene moiety derived from 1,2-propylene oxide, where the resulting structure of $R^2O$ in Formula I can be either [—$CH_2CH(CH_3)$—O—] or [—$CH(CH_3)CH_2$—O—]. $R^3O$ is an oxybutylene moiety derived from butylene oxide, where the resulting structure of $R^3O$ in Formula I can be either [—$CH_2CH(C_2H_5)$—O—] or [—$CH(C_2H_5)CH_2$—O—] when $R^3O$ is derived from 1,2-butylene oxide. When $R_3O$ is derived from 2,3 butylene oxide the oxybutylene moiety will be [—$OCH(CH_3)CH(CH_3)$—]. For the various embodiments, $R^2O$ and $R^3O$ are in a block or a random distribution in Formula I. $R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. The values for n and m are each independently integers ranging from 0 to 20, where n+m is greater than 0. The value for p is an integer from 1 to 4.

The E-OSP of the present disclosure can have one or more properties that are desirable for various lubricant applications. For instance, viscosity index is a measure of how the viscosity of the lubricant changes with temperature. For lubricants, relatively lower viscosity index values can indicate a greater reduction in a lubricant's viscosity at higher temperatures, as compared to a lubricant having a relatively higher viscosity index value. As such, for a number of applications, relatively higher viscosity index values are advantageous so that the lubricant maintains a generally steady viscosity with less pronounced viscosity changes for extremes of temperatures that go from lower temperatures to higher temperatures. The E-OSP disclosed herein may provide higher viscosity index values, as compared to some other lubricants.

The E-OSP disclosed herein have a low viscosity as they have a kinematic viscosity at 40° C. of less than 25 centistokes (cSt) and a kinematic viscosity at 100° C. of 6 cSt or less (both kinematic viscosities measured according to ASTM D7042). As such, the E-OSPs may advantageously be utilized as low viscosity lubricants and/or for various low viscosity lubricant applications. The E-OSPs may have a kinematic viscosity, as determined by ASTM D7042, at 40° C. from a lower limit 8.0 or 9.0 cSt to an upper limit of 24.5 or 24.0 cSt. The E-OSPs may have a kinematic viscosity, as determined by ASTM D7042, at 100° C. from a lower limit 1.0 or 2.5 cSt to an upper limit of 6.0 or 5.5 cSt. As mentioned, the E-OSPs disclosed herein can advantageously provide relatively lower viscosities at low temperatures, as compared to some other lubricants, such as similar non-esterified oil soluble polyalkylene glycols. Additionally, low viscosity lubricants having a relatively lower viscosity, e.g., kinematic and/or dynamic, at low temperatures, such as at or below 0° C., can advantageously help to provide lower energy losses, such as when pumping the lubricant around an automotive engine. The esterified oil soluble polyalkylene glycols disclosed herein can provide relatively lower viscosities e.g., kinematic and/or dynamic, at low temperatures, as compared to some other lubricants.

The E-OSP of Formula I is a reaction product of an oil soluble polyalkylene glycol and an acid. Unlike mineral oil base oils, oil soluble polyalkylene glycols have a significant presence of oxygen in the polymer backbone. Embodiments of the present disclosure provide that oil soluble polyalkylene glycols are alcohol initiated copolymers of propylene oxide and butylene oxide, where units derived from butylene oxide are from 50 weight percent to 95 weight percent based upon a total of units derived from propylene oxide and butylene oxide. All individual values and subranges from 50 weight percent to 95 weight percent are included; for example, the oil soluble polyalkylene glycol may have units derived from butylene oxide from a lower limit of 50, 55, or 60 weight percent to an upper limit of 95, 90, or 85 weight percent based upon the total of units derived from propylene oxide and butylene oxide. For the various embodiments, the propylene oxide can be 1,2-propylene oxide and/or 1,3-propylene oxide. For the various embodiments, the butylene oxide can be selected from 1,2-butylene oxide or 2,3-butylene oxide. Preferably, 1,2-butylene oxide is used in forming the oil soluble polyalkylene glycol.

The alcohol initiator for the oil soluble polyalkylene glycol may be a monol, a diol, a triol, a tetrol, or a combination thereof. Examples of the alcohol initiator include, but are not limited to, monols such as methanol, ethanol, butanol, octanol and dodecanol. Examples of diols are ethylene glycol, 1,2-propylene glycol, 1,3-propylene glycol and 1,4 butanediol. Examples of triols are glycerol and trimethylolpropane. An example of a tetrol is pentaerythritiol. Combinations of monols, diols, triols and/or tetrol may be used. The alcohol initiator may include from 1 to 30 carbon atoms. All individual values and subranges from 1 to 30 carbon atoms are included; for example, the alcohol initiator may have from a lower limit of 1, 3, or 5 carbon atoms to an upper limit of 30, 25, or 20 carbon atoms.

The oil soluble polyalkylene glycols may be prepared by a known process with known conditions. The oil soluble polyalkylene glycols may be obtained commercially. Examples of commercial oil soluble polyalkylene glycols include, but are not limited to, oil soluble polyalkylene glycols under the trade name UCON™, such as UCON™ OSP-12 and UCON™ OSP-18 both available from The Dow Chemical Company.

The acid that is reacted with the oil soluble polyalkylene glycol to form the esterified oil soluble polyalkylene glycols disclosed herein can be a carboxylic acid. Examples of such carboxylic acids include, but are not limited to, acetic acid, propanoic acid, pentanoic acid, e.g., n-pentanoic acid, valeric acid, e.g., isovaleric acid, caprylic acid, dodecanoic acid, combinations thereof.

To form the E-OSP disclosed herein, the oil soluble polyalkylene glycol and the acid may be reacted at a molar ratio of 10 moles of oil soluble polyalkylene glycol:1 mole of acid to 1 mole of oil soluble polyalkylene glycol:10 moles of acid. All individual values and subranges from 10:1 moles of oil soluble polyalkylene glycol to moles of acid to 1:10 moles of oil soluble polyalkylene glycol to moles of acid are included; for example oil soluble polyalkylene glycol and the acid may be reacted at a molar ratio of 10:1, 9:1, 8:1, 7:1, 6:1, 5:1, 4:1, 3:1, 2:1, 1:1, 1:2, 1:3, 1:4, 1:5, 1:6, 1:7, 1:8, 1:9, or 1:10 moles of oil soluble polyalkylene glycol to moles of acid.

The E-OSP may be prepared by a known process with known conditions. For instance, the esterified oil soluble polyalkylene glycols disclosed herein may be formed by an esterification process, e.g., Fisher Esterification. Generally, the reactions for the esterification process can take place at atmospheric pressure (101,325 Pa), at a temperature of 60 to 170° C. for 1 to 10 hours. In addition, known components such as acid catalysts, neutralizers, and/or salt absorbers, among other known components, may be utilized in the esterification reaction. An example of a preferred acid catalyst is p-toluenesulfonic acid, among others. Examples of neutralizers are sodium carbonate and potassium hydroxide, among others. An example of a salt absorber is magnesium silicate, among others.

As discussed above, the E-OSP of the present disclosure has the structure of Formula I:

$$R^1[O(R^2O)_n(R^3O)_m(C{=}O)R^4]_p \qquad \text{Formula I}$$

$R^1$ is a linear alkyl having 1 to 18 carbon atoms, a branched alkyl having 4 to 18 carbon atoms or an aryl with 6 to 30 carbon atoms. Preferably, $R^1$ is a linear alkyl with 10 to 14 carbon atoms. $R^1$ corresponds to the residual of an alcohol initiator used during the polymerization of the oil soluble polyalkylene glycol discussed herein. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^1$ can have 6 to 30 carbons.

$R^2O$ is an oxypropylene moiety derived from 1,2-propylene oxide, where the resulting structure of $R^2O$ in Formula I can be either [—$CH_2CH(CH_3)$—O—] or [—$CH(CH_3)CH_2$—O—]. $R^3O$ is an oxybutylene moiety derived from butylene oxide, where the resulting structure of $R^3O$ in Formula I can be either [—$CH_2CH(C_2H_5)$—O—] or [—$CH(C_2H_5)CH_2$—O—] when $R^3O$ is derived from 1,2-butylene oxide. For the various embodiments, $R^2O$ and $R^3O$ are in a block or a random distribution in Formula I.

$R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^4$ can have 6 to 18 carbons.

The values for n and m are each independently integers ranging from 0 to 20, where n+m is greater than 0. Preferably, n and m are each independently integers ranging from 5 to 10. In another preferred embodiment, n and m are each independently integers ranging from 3 to 5. The value for p is an integer from 1 to 4.

The E-OSPs disclosed herein may have a viscosity index determined according to ASTM D2270 from 130 to 200. All individual values and subranges from 130 to 200 are included; for example, the E-OSPs may have a viscosity index from a lower limit of 130 or 135 to an upper limit of 200 or 195. This improved viscosity index, as compared to some other lubricants, such as similar non-esterified oil soluble polyalkylene glycols, is advantageous to a previous process for increasing viscosity index, i.e. an alkylation capping process, because esterification can be achieved via a simpler process and/or at a reduced cost.

The lubricant composition is also comprised of an antioxidant. The antioxidant may be any and useful so long as the antioxidant is at least soluble in the E-OSP in any amount of at least about 0.5% by weight at room temperature (about 23° C.). Preferably, the antioxidant is soluble in an amount of at least 0.75%, 1%, 1.5% or 2% and may be soluble in an amount up to 20%, but generally is present in an amount of at most about 10%, or 5%. Useful antioxidants are compounds that are comprised of a hindered phenol, amine (especially aromatic amine), sulfide, disulfide, sulfoxide, phosphite, selenide, dithiocarbamates or combination thereof. Examples of antioxidants include the hindered phenols such as 2,6-di-tertiary-butyl-4-methyl-phenol, 4,4'methylene bis (2,6-tertiary-butyl phenol) and 4,4'thiobis (2-methyl-6-tertiary-butyl phenol); and amines such as N-phenyl-alpha-naphthylamine, tetramethyldiaminodiphenylmethane, anthranilic acid, phenothiazine and alkylated derivatives of phenothiazine. Further examples of antioxidants are described in U.S. Pat. Nos. 1,988,299; 2,000,045; 2,202,877; 2,265,582; 2,868,730; 3,032,502; 3,038,858; 3,038,859; 3,043,775; 3,065,178; and 3,132,103 as well as GB Pat. No. 1,030,399 and WO 1987005320. Particular antioxidants that may be useful include those known in the art under the tradenames IRGANOX and IRGAFOS from BASF and VANLUBE from Vanderbilt Chemicals. Particular examples include IRGANOX L101, L135, L109, L06 and VANLUBE 961, and IRGAFOS 168 antioxidants.

When using an antioxidant containing a hindered phenol, generally, the amount of hindered phenol moiety present within the molecule should be 4 or less, and preferably from 1 to 3. If there are too many phenol moieties, the solubility generally is decreased and the reduction of the NOACK volatility is not achieved. Desirably, the antioxidant is a hindered phenol, amine (e.g., aminic), or combination thereof. In some instances, a hindered phenol oxidant having 4 hindered phenol moieties or more may be combined with a hindered phenol having less than 4 hindered phenols or an aminic antioxidant realizing improved total solubility and in some instances further improved NOACK volatility even at lower concentrations of the antioxidant in the E-OSP.

To make the lubricant composition of E-OSP and antioxidant, the antioxidant is dissolved into the E-OSP. The dissolution may be carried out at any useful temperature such as ambient temperature, but may be facilitated by heating to accelerate the dissolution. The heating generally is to a temperature less than where any significant volatility or decomposition occurs of either the antioxidant or E-OSP such as from about 30° C., 40° C., or 50° C. to about 200° C., 150° C. or 100° C. The dissolution may be accomplished using any known method or apparatus of mixing two components together.

The lubricant composition of E-OSP and antioxidant may be used as an additive to a base hydrocarbon oil to make a hydrocarbon lubricant composition where the E-OSPs are oil soluble (are miscible) in the base oil. The lubricant formulation of the present disclosure can include greater than 50 to 99.9 weight percent (wt. %) of the base oil and 0.01 wt. % up to 50% by weight of the E-OSP and antioxidant composition, where the wt. % is based on the total weight of the hydrocarbon lubricant composition. In a preferred embodiment, the hydrocarbon lubricant formulation comprises 80% to 99% by weight of the hydrocarbon base oil and 1% to 20% by weight of the E-OSP and antioxidant.

The hydrocarbon base oil for the lubricant formulation is selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof. Preferably, the base oil of the hydrocarbon lubricant composition is an API Group III or IV hydrocarbon base oil. The composition of API Group I-IV hydrocarbon oils are as follows. Group II and Group III hydrocarbon oils are typically prepared from conventional Group I feed stocks using a severe hydrogenation step to reduce the aromatic, sulfur and nitrogen content, followed by de-waxing, hydro-finishing, extraction and/or distillation steps to produce the finished base oil. Group II and HI base stocks differ from conventional solvent refined Group I base stocks in that their sulfur, nitrogen and aromatic contents are very low. As a result, these base oils are compositionally very different from conventional solvent refined base stocks. The API has categorized these different base stock types as follows: Group I, >0.03 wt. % sulfur, and/or <90 vol % saturates, viscosity index between 80 and 120; Group II, ≤5-0.03 wt. % sulfur, and ≥90 vol % saturates, viscosity index between 80 and 120; Group III, ≤5-0.03 wt. % sulfur, and ≥90 vol % saturates, viscosity index >120. Group IV are polyalphaolefins (PAO). Hydrotreated base stocks and catalytically dewaxed base stocks, because of their low sulfur and aromatics content, generally fall into the Group II and Group III categories.

The E-OSP antioxidant composition when added to a hydrocarbon oil may not only help to improve the NOACK air volatility, but also improve other properties such as the ability to incorporate antioxidants (solubilize) at higher concentrations within the hydrocarbon lubricant composition in the absence of the E-OSP. Likewise the E-OSP antioxidant composition may improve the viscosity index of the base oil having a kinematic viscosity of at least 8 cSt at 40° C. as measured according to ASTM D7042, while simultaneously decreasing the lubricant low temperature (0° C. or −20° C.) viscosity by blending E-OSP antioxidant composition into the hydrocarbon base oil. In other words, the inclusion of an E-OSP antioxidant composition into a hydrocarbon base oil may lead to a desirable improvement in the viscosity index and a favorable decrease in low temperature viscosity compared to the hydrocarbon base oil alone.

The present disclosure also provides for a method of forming the hydrocarbon lubricant composition for use, for example, in an internal combustion engine. The method includes providing the hydrocarbon base oil, as described herein, and admixing with the hydrocarbon base oil with the already formed E-OSP and antioxidant composition, which is to say the antioxidant is first dissolved into the E-OSP and then admixed into the hydrocarbon base oil, to form the hydrocarbon lubricant composition that may be particularly useful for an internal combustion engine.

The lubricant composition of the E-OSP and antioxidant as well as the hydrocarbon lubricant composition may also advantageously contain one or more additives such as ferrous corrosion inhibitors, yellow metal passivators, viscosity index improvers, pour point depressants, anti-wear additives, extreme pressure additives, antifoams, demulsifiers, dyes and the like.

EXAMPLES

Abbreviations

American Society for Testing and Materials (ASTM); Viscosity Index (VI); Grams (g); Degree Celsius (° C.); Mole (mol); Comparative Examples (Comp. Ex.); Inventive Examples (Ex).; Kinematic Viscosity (KV), potassium hydroxide (KOH), sodium carbonate ($Na_2CO_3$) and p-toluenesulfonic acid (PTSA).

Test Methods

The following methods were used to measure the properties of the Examples and Comparative Examples provided herein. KV was measured according to ASTM D7042 [$KV_{40}$ is the kinematic viscosity at 40° C., $KV_{100}$ is the kinematic viscosity at 100° C., $KV_{-20}$ is the kinematic viscosity at −20° C.]. The pour point was measured according to ASTM D97. Calculate VI according to ASTM D2270.

Materials

TABLE 1

| Materials | | | |
|---|---|---|---|
| Ingredient | Acronym | Description | Source |
| OSP BASE OILS | | | |
| UCON ™ OSP-12 | OSP-12 | Dodecanol (C12) initiated PO/BO (50/50 w/w), random copolymer with a typical kinematic viscosity at 40° C. ($KV_{40}$) of 12 cSt ($mm^2$/sec) a typical kinematic viscosity at 100° C. ($KV_{100}$) of 3 cSt and viscosity index of 103. | The Dow Chemical Company (TDCC) |
| UCON ™ OSP-18 | OSP-18 | Dodecanol initiated PO/BO (50/50 w/w), random copolymer with a typical kinematic viscosity at 40° C. of 18 cSt and a typical kinematic viscosity at 100° C. ($KV_{100}$) of 4 cSt and viscosity index of 121. | TDCC |
| EXPERIMENTAL ESTERIFIED OSPs | | | |
| OSP18-C5 | OSP18-C5 | Esterified OSP18 by reaction with valeric acid (C5). Experimental sample with $KV_{40}$ of 15.3 cSt, $KV_{100}$ of 4.0 cSt, pour point of −55° C. and VI of 160. | Synthesized |
| OSP12-C5 | OSP12-C5 | Esterified OSP12 by reaction with valeric acid (C5). Experimental sample with $KV_{40}$ of 10.3 cSt, $KV_{100}$ of 3.06 cSt, pour point of −43° C. and VI of 171. | Synthesized |
| HYDROCARBON BASE OILS | | | |
| YUBASE 3 | Y3 | An API Group III base oil with a typical kinematic viscosity at 40° C. of 3.1 $mm^2$/sec (cSt) and kinematic viscosity at 40° C. of 12.4 $mm^2$/sec, VI of 122 and Noack volatility of about 15% using DIN 51581. | SK Oil |
| YUBASE 4 | Y4 | An API Group III base oil with a typical kinematic viscosity at 100° C. of 4.3 cSt and kinematic viscosity at 40° C. of 19.6 $mm^2$/sec, VI of 122 and Noack volatility of 40% using DIN 51581. | SK Oil |
| ANTIOXIDANTS | | | |
| VANLUBE 961 | 961 | Aminic Anti-oxidant Benzeneamine, -N-phenyl-, reaction product with 2,4,4-trimethylpentene and 2-methylpropene; CAS:68411-46-1 | Vanderbilt |
| IRGANOX L 06 | 06 | Aminic Anti-oxidant Alkylated phenyl alpha naphthylamine; CAS: 68259-36-9. | BASF |
| IRGANOX L 135 | 135 | Hindered Phenolic anti-oxidant; CAS No.: 125643-61-0. | BASF |
| IRGANOX L 101 | 101 | High molecular weight hindered phenolic antioxidant. | BASF |
| IRGAFOS 168 | 168 | Tris (ditertiary butyl phenyl) phosphite | BASF |

The following compounds were obtained from Sinopharm Chemical Reagent Co. Ltd: PTSA, $Na_2CO_3$ (neutralizer), KOH (neutralizer), magnesium silicate (salt absorber). The following compound was obtained from Energy Chemical; n-pentanoic acid (acid)

Synthesis of OSP-Esters (E-OSPS)

Esterification of OSP18 by n-Pentanoic Acid (OSP18-05)

UCON™ OSP-18 (350 g, 0.749 mol) and n-pentanoic acid (76.5 g, 0.749 mol) in toluene (500 mL) was stirred at room temperature (23° C.) to form a first mixture. PTSA (1.42 g, 0.00749 mol) was added with stirring to the first mixture to form a second mixture. The second mixture was refluxed at 165° C. for overnight with Dean-Stark to remove 13.0 mL water to form a third mixture. The third mixture was cooled to room temperature and then $Na_2CO_3$ (50 g) was added to form a fourth mixture. The forth mixture was stirred overnight to neutralize the PTSA. Magnesium silicate (10 g) was added to the forth mixture to form a fifth mixture and stirred at 60° C. for 3 hours to absorb the generated salt in the fifth mixture. The fifth mixture was filtered through a filter paper. After filtration, residue solvent was removed by vacuum distillation to obtain a dark yellow liquid (330 g, yield=80%, mol capping rate=98%).

Esterification of OSP12 by n-Pentanoic Acid (OSP12-05)

UCON™ OSP-12 (374 g, 1 mol) and n-pentanoic acid (102 g, 1 mol) in toluene (500 mL) were mixed and stirred at room temperature (23° C.) to form a first mixture. PTSA (1.90 g, 0.001 mol) was added with stirring to the first mixture to form a second mixture. The second mixture was refluxed at 135° C. for overnight with Dean-Stark to remove 18.0 mL water to form a third mixture. The third mixture was cooled to room temperature and then KOH (1.12 g, 0.002 mol) was added to form a fourth mixture. The forth mixture was stirred overnight to neutralize the PTSA. Magnesium silicate (10 g) was added to the forth mixture to form a fifth mixture and stirred at 60° C. for 3 hours to absorb the generated salt in the fifth mixture. The fifth mixture was filtered through a filter paper. After filtration, the residue solvent was removed by vacuum distillation to obtain a light yellow liquid (388 g, yield=84%, mol capping rate=94%).

Formulation Preparation

Formulations were prepared by adding each component of the formulation as identified in Tables 2 to 4 into a 20 mL glass beaker to from a 10 mL sample at 80° C. for 30 minutes stirring at 3000 rpm. Each resulting formulation was clear and homogenous. In each instance of addition of antioxidant in Table 2 to an E-OSP the NOACK volatility improved substantially up to its solubility limit.

Table 3 shows that the addition of E-OSP or antioxidant to a base hydrocarbon oil raises the NOACK volatility. Surprisingly, the combination of the E-OSP and antioxidant realizes a lower NOACK volatility compared to the individual additions to the hydrocarbon base oil (see samples C1, C2, C3 and Comp. Ex. C, D, and E as well as D1, D2, and D3 and Comp. Ex. F, G, and H). Likewise, the combination of the E-OSP and antioxidant allows for the incorporation of antioxidant in a hydrocarbon base oil that otherwise would be insoluble alone in the hydrocarbon base oil (e.g., see D6 and Comp. Ex. J). Table 4 shows that combinations of antioxidants may be employed with an E-OSP in a hydrocarbon oil and may allow for the incorporation of an antioxidant at a level greater than if only added by itself to the hydrocarbon oil (see Sample D17 and Comp. Ex. I).

TABLE 2

Antioxidant additions to E-OSPs
NOACK Values of E-OSP Formulations

| Sample Name | Comp. Ex. A | A1 Ex | A2 EX. | A3 | A4 |
|---|---|---|---|---|---|
| OSP18-C5, % | 100 | 99.75 | 99.5 | 99 | 98 |
| Irganox L101, % | | 0.25 | 0.5 | 1 | 2 |
| Noack, % | 31.5 | 29.9 | 24.8 | Insoluble | Insoluble |
| % NOACK reduction | | 5.1 | 21.3 | | |

| Sample Name | Comp. Ex. B | B1 Ex. | B2 Ex. | B3 | B4 |
|---|---|---|---|---|---|
| OSP12-C5, % | 100 | 99.75 | 99.5 | 99 | 98 |
| Irganox L101, % | | 0.25 | 0.5 | 1 | 2 |
| Noack, % | 39.5 | 33.6 | 24.7 | Insoluble | Insoluble |
| % NOACK reduction | | 14.9 | 37.5 | | |

| Sample Name | A5 Ex | A6 Ex | A7 Ex |
|---|---|---|---|
| OSP18-C5, % | 99.75 | 98 | 95 |
| Irganox L135, % | 0.25 | 2 | 5 |
| Noack, % | 26.9 | 11.9 | 9.0 |
| % NOACK reduction | 14.6 | 62.3 | 71.4 |

| Sample Name | B5 Ex | B6 Ex | B7 Ex |
|---|---|---|---|
| OSP12-C5, % | 99.75 | 98 | 95 |
| Irganox L135, % | 0.25 | 2 | 5 |
| Noack, % | 33.4 | 19.9 | 17.3 |
| % NOACK reduction | 15.5 | 49.6 | 56.2 |

| Sample Name | A8 Ex | A9 Ex | A10 Ex |
|---|---|---|---|
| OSP18-C5, % | 99.75 | 98 | 95 |
| Vanlube 961, % | 0.25 | 2 | 5 |
| Noack, % | 21.7 | 9.4 | 8.2 |
| % NOACK reduction | 31.1 | 70.2 | 74.0 |

| Sample Name | B8 Ex | B9 Ex | B10 Ex |
|---|---|---|---|
| OSP12-C5, % | 99.75 | 98 | 95 |
| Vanlube 961, % | 0.25 | 2 | 5 |
| Noack, % | 27.1 | 16.7 | 16.8 |
| % NOACK reduction | 31.4 | 57.7 | 57.5 |

| Sample Name | A11 Ex | A12 Ex | A13 |
|---|---|---|---|
| OSP18-C5, % | 99.75 | 98 | 95 |
| Irganox L06, % | 0.25 | 2 | 5 |
| Noack, % | 20.3 | 8.6 | Insoluble |
| % NOACK reduction | 35.6 | 72.7 | |

| Sample Name | B11 Ex | B12 Ex | B13 |
|---|---|---|---|
| OSP12-C5, % | 99.75 | 98 | 95 |
| Irganox L06, % | 0.25 | 2 | 5 |
| Noack, % | 26.3 | 17.5 | Insoluble |
| % NOACK reduction | 33.4 | 55.7 | |

| Sample Name | A14 Ex | A15 Ex | A16 Ex |
|---|---|---|---|
| OSP18-C5, % | 99.75 | 98 | 95 |
| Vanlube 961/Irganox L06 (1:1), % | 0.25 | 2 | 5 |
| Noack, % | 17.5 | 9.6 | 7.8 |
| % NOACK reduction | 44.6 | 69.5 | 75.3 |

| Sample Name | B14 Ex | B15 Ex | B16 Ex |
|---|---|---|---|
| OSP12-C5, % | 99.75 | 98 | 95 |
| Vanlube 961/Irganox L06 (1:1), % | 0.25 | 2 | 5 |

TABLE 2-continued

| Antioxidant additions to E-OSPs NOACK Values of E-OSP Formulations | | | |
|---|---|---|---|
| Noack, % | 24.8 | 15.9 | 18.2 |
| % NOACK reduction | 37.3 | 59.7 | 53.9 |
| Sample Name | A17 Ex | A18 Ex | A19 |
| OSP18-C5 | 99.75 | 99.5 | 99 |
| Vanlube 961/Irganox L101 (1:1), % | 0.25 | 0.5 | 1 |
| Noack, % | 22.1 | 15.0 | Insoluble |
| % NOACK reduction | 29.8 | 52.4 | |
| Sample Name | B17 Ex. | B18 Ex. | B19 |
| OSP12-C5 | 99.75 | 99.5 | 99 |
| Vanlube 961/Irganox L101 (1:1), % | 0.25 | 0.5 | 1 |
| Noack, % | 35.6 | 28.0 | Insoluble |
| % NOACK reduction | 9.9 | 29.1 | |
| Sample Name | A20 Ex | A21 Ex | A22 Ex |
| OSP18-C5, % | 99.75 | 98 | 95 |
| Vanlube 961/Irganox L135 (1:1), % | 0.25 | 2 | 5 |
| Noack, % | 23.1 | 8.0 | 8.3 |
| % NOACK reduction | 26.6 | 74.7 | 73.7 |
| Sample Name | B20 Ex | B21 Ex | B22 Ex |
| OSP12-C5, % | 99.75 | 98 | 95 |
| Vanlube 961/Irganox L135 (1:1), % | 0.25 | 2 | 5 |
| Noack, % | 27.4 | 17.0 | 17.5 |
| % NOACK reduction | 30.7 | 57.0 | 55.7 |

Ex. = Example and C. Ex = Comparative Example in row after "Sample Name" rows.
% NOACK reduction is versus the E-OSP NOACK %.

TABLE 3

| Singular Antioxidant Addition and E-OSP Addition to Hydrocarbon Oils | | | | | | |
|---|---|---|---|---|---|---|
| Sample Name | Comp. Ex. C C. Ex | Comp. Ex. D C. Ex | C1 Ex | C2 Ex | C3 Ex | Comp. Ex. E C. Ex |
| Yubase 4, % | 100 | 90 | 93 | 88 | 73 | 98 |
| OSP18-C5, % | | 10 | 5 | 10 | 25 | |
| Irganox L135, % | | | 2 | 2 | 2 | 2 |
| Noack, % | 12.7 | 17.7 | 16.0 | 14.0 | 13.6 | 15.6 |
| % NOACK reduction | | 0 | 0 | 0 | 0 | 0 |
| Sample Name | Comp. Ex. F C. Ex | Comp. Ex. G C. Ex | D1 Ex | D2 Ex | D3 Ex | Comp. Ex. H C. Ex |
| Yubase 3, % | 100 | 90 | 93 | 88 | 73 | 98 |
| OSP12-C5, % | | 10 | 5 | 10 | 25 | |
| Irganox L135, % | | | 2 | 2 | 2 | 2 |
| Noack, % | 39.4 | 39.3 | 35.5 | 35.5 | 32.6 | 37.3 |
| % NOACK reduction | | 0.3 | 9.9 | 9.9 | 17.3 | 5.3 |

| Sample Name | C4 Ex | C5 Ex |
|---|---|---|
| Yubase 4, % | 89.5 | 85 |
| OSP18-C5, % | 10 | 10 |
| Irganox L135, % | 0.5 | 5 |
| Noack, % | 16.1 | 14.6 |
| % NOACK reduction | 0 | 0 |
| Sample Name | D4 Ex | D5 Ex |
| Yubase 3, % | 89.5 | 85 |
| OSP12-C5, % | 10 | 10 |
| Irganox L135, % | 0.5 | 5 |

TABLE 3-continued

| Singular Antioxidant Addition and E-OSP Addition to Hydrocarbon Oils | | |
|---|---|---|
| Noack, % | 34.8 | 36.2 |
| % NOACK reduction | 11.7 | 8.2 |

| Sample Name | C6 Ex | Comp. Ex. 1 C. Ex |
|---|---|---|
| Yubase 4, % | 74.75 | 99.75 |
| OSP18-C5, % | 25 | |
| Irganox L101, % | 0.25 | 0.25 |
| Noack, % | 16.3 | Insoluble |
| % NOACK reduction | 0 | |

| Sample Name | D6 Ex | Comp. Ex. J C. Ex |
|---|---|---|
| Yubase 3, % | 74.75 | 99.75 |
| OSP12-C5, % | 25 | |
| Irganox L101, % | 0.25 | 0.25 |
| Noack, % | 35.9 | Insoluble |
| % NOACK reduction | 8.9 | |

| Sample Name | C7 Ex | C8 Ex | C9 Ex | Comp. Ex. K C. Ex |
|---|---|---|---|---|
| Yubase 4, % | 93 | 88 | 73 | 98 |
| OSP18-C5, % | 5 | 10 | 25 | |
| Vanlube 961, % | 2 | 2 | 2 | 2 |
| Noack, % | 14.8 | 15.4 | 12.3 | 15.1 |
| % NOACK reduction | 0 | 0 | 3.2 | 0 |

| Sample Name | D7 Ex | D8 Ex | D9 Ex | Comp. Ex. L C. Ex |
|---|---|---|---|---|
| Yubase 3, % | 93 | 88 | 73 | 98 |
| OSP12-C5, % | 5 | 10 | 25 | |
| Vanlube 961, % | 2 | 2 | 2 | 2 |
| Noack, % | 33.3 | 36.0 | 34.5 | 38.2 |
| % NOACK reduction | 15.5 | 8.7 | 12.7 | 3.0 |

| Sample Name | C10 Ex | C11 EX |
|---|---|---|
| Yubase 4, % | 89.5 | 85 |
| OSP18-C5, % | 10 | 10 |
| Vanlube 961 | 0.5 | 5 |
| Noack, % | 15.9 | 16.4 |
| % NOACK reduction | 0 | 0 |

| Sample Name | D10 Ex | D11 Ex |
|---|---|---|
| Yubase 3, % | 89.5 | 85 |
| OSP12-C5, % | 10 | 10 |
| Vanlube 961, % | 0.5 | 5 |
| Noack, % | 35.6 | 35.3 |
| % NOACK reduction | 9.7 | 10.4 |

Ex. = Example and C. Ex = Comparative Example in row after "Sample Name" rows.
% NOACK reduction is versus the hydrocarbon base oil NOACK %.

TABLE 4

| Combinations of Antioxidants and E-OSPs added to Hydrocarbon Oils. | | | |
|---|---|---|---|
| Sample Name | C12 Ex | C13 Ex | C14 Ex |
| Yubase 4, % | 93 | 88 | 73 |
| OSP18-C5, % | 5 | 10 | 25 |
| Vanlube 961/Irganox L135 (1:1), % | 2 | 2 | 2 |
| Noack, % | 15.1 | 15.2 | 14.0 |
| % NOACK reduction | 0 | 0 | 0 |

TABLE 4-continued

| Combinations of Antioxidants and E-OSPs added to Hydrocarbon Oils. | | | |
|---|---|---|---|
| Sample Name | D12 Ex | D13 Ex | D14 Ex |
| Yubase 3, % | 93 | 88 | 73 |
| OSP12-C5, % | 5 | 10 | 25 |
| Vanlube 961/Irganox L135 (1:1), % | 2 | 2 | 2 |
| Noack, % | 36.3 | 32.3 | 31.5 |
| % NOACK reduction | 7.9 | 18.0 | 20.0 |

TABLE 4-continued

Combinations of Antioxidants and E-OSPs added to Hydrocarbon Oils.

| Sample Name | C15 C. Ex | C16 C. Ex |
|---|---|---|
| Yubase 4, % | 89.5 | 85 |
| OSP18-C5, % | 10 | 10 |
| Vanlube 961/Irganox L135 (1:1), % | 0.5 | 5 |
| Noack, % | 13.9 | 14.2 |
| % NOACK reduction | 0 | 0 |

| Sample Name | D15 Ex | D16 Ex |
|---|---|---|
| Yubase 3, % | 89.5 | 85 |
| OSP12-C5, % | 10 | 10 |
| Vanlube 961/Irganox L135 (1:1), % | 0.5 | 5 |
| Noack, % | 35.2 | 35.4 |
| % NOACK reduction | 10.6 | 10.2 |

| Sample Name | C17 C. Ex | Comp. Ex. M C. Ex |
|---|---|---|
| Yubase 4, % | 74.5 | 99.5 |
| OSP18-C5, % | 25 | |
| Vanlube 961/Irganox L101 (1:1), % | 0.5 | 0.5 |
| Noack, % | 12.5 | Insoluble |
| % NOACK reduction | 1.6 | 0 |

| Sample Name | D17 Ex | Comp. Ex. N C. Ex |
|---|---|---|
| Yubase 3, % | 74.5 | 99.5 |
| OSP12-C5, % | 25 | |
| Vanlube 961/Irganox L101 (1:1), % | 0.5 | 0.5 |
| Noack, % | 31.3 | Insoluble |
| % NOACK reduction | 20.6 | |

Ex. = Example and C. Ex. = Comparative Example in row after "Sample Name" rows. % NOACK reduction is versus the hydrocarbon base oil NOACK %.

We claim:

1. A lubricant composition, comprising:

an antioxidant; and an esterified polyalkylene glycol:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 2 to 10, and p is an integer from 1 to 4, wherein the antioxidant is present in an amount by weight of at least 0.5% to 20% based upon the weight of the antioxidant and the esterified polyalkylene glycol and the antioxidant is soluble in the esterified polyalkylene glycol in an amount of at least 0.5% by weight.

2. The lubricant composition of claim 1, wherein $R^3O$ is derived from 1,2-butylene oxide.

3. The lubricant composition of claim 1, wherein $R^4$ is a linear alkyl with 2 to 8 carbon atoms.

4. The lubricant formulation of claim 1, wherein $R^1$ is a linear alkyl with 8 to 14 carbon atoms.

5. The lubricant composition of claim 1, wherein the antioxidant is comprised of a hindered phenol, amine, sulfide, disulfide, sulfoxide, phosphite, selenide, dithiocarbamate or combination thereof.

6. The lubricant composition of claim 1, wherein the antioxidant is comprised of a hindered phenol, amine, sulfide, phosphite or combination thereof.

7. The lubricant composition of claim 1, wherein the antioxidant is comprised of a hindered phenol, amine or combination thereof.

8. The lubricant composition of claim 1, wherein the antioxidant is comprised of a hindered phenol and said hindered phenol has from 1 to 3 phenol rings.

9. The lubricant composition of claim 1, wherein the antioxidant is soluble in the esterified polyalkylene glycol in an amount of at least 0.75% by weight.

10. The lubricant composition of claim 1, wherein the amount of antioxidant is at most 10% by weight.

11. The lubricant composition of claim 1, wherein the lubricant composition is in the absence of any hydrocarbon base oil.

12. A hydrocarbon lubricant composition comprised of, (i) an antioxidant;

(ii) an esterified polyalkylene glycol:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 2 to 10, and p is an integer from 1 to 4; and (iii) a hydrocarbon base oil, wherein the antioxidant is present in an amount by weight of at least 0.1% to 10% based upon the weight of the hydrocarbon lubricant composition and the antioxidant is soluble in the esterified polyalkylene glycol in an amount of at least 0.5% by weight and the hydrocarbon oil is present in the composition in an amount of at least 50% by weight of the total weight of the hydrocarbon lubricant composition.

13. The hydrocarbon lubricant composition of claim 12, wherein the solubility of the antioxidant is greater by weight in the hydrocarbon lubricant composition compared to the antioxidant's solubility in hydrocarbon base oil without the esterified polyalkylene glycol.

14. The hydrocarbon lubricant composition of claim 12, wherein the hydrocarbon base oil is selected from an American Petroleum Institute (API) Group I hydrocarbon base oil, an API Group II hydrocarbon base oil, an API Group III hydrocarbon base oil, an API Group IV hydrocarbon base oil or a combination thereof.

15. The hydrocarbon lubricant composition of claim 12, wherein the base oil is an API Group III or API Group IV hydrocarbon base oil.

16. The hydrocarbon lubricant composition of claim 12, wherein the esterified polyalkylene glycol is present in an amount of 1% to 30% by weight of the hydrocarbon lubricant composition.

17. The hydrocarbon lubricant composition of claim 12, wherein the antioxidant is present in an amount of at least 0.25% by weight of the hydrocarbon lubricant composition.

18. A method of forming a hydrocarbon lubricant composition comprising:

(i) dissolving, first, an antioxidant into an esterified polyalkylene glycol represented by the following structure:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 2 to 10, and p is an integer from 1 to 4, to form a solution of the antioxidant and esterified polyalkylene glycol, and then (ii) admixing a base hydrocarbon oil with the solution of the antioxidant and esterified polyalkylene glycol to form the hydrocarbon lubricant composition, wherein said hydrocarbon lubricant composition is a homogeneous solution.

19. The method of claim 18, wherein the amount of the antioxidant present in the hydrocarbon lubricant composition is greater than an amount that would be soluble in the base hydrocarbon oil in the absence of the esterified polyalkylene glycol.

20. The method of claim 18, wherein n and m are each independently integers ranging from 2-6.

* * * * *